US008181740B2

(12) United States Patent
Blomberg et al.

(10) Patent No.: US 8,181,740 B2
(45) Date of Patent: May 22, 2012

(54) JET BRIDGE FALL PROTECTION ASSEMBLY

(75) Inventors: John P. Blomberg, Red Wing, MN (US); Scott C. Casebolt, St. Paul Park, MN (US); Matthew J. Blackford, Hastings, MN (US)

(73) Assignee: D B Industries, Inc., Red Wing, MN (US)

( * ) Notice: Subject to any disclaimer, the term of this patent is extended or adjusted under 35 U.S.C. 154(b) by 201 days.

(21) Appl. No.: 12/732,493

(22) Filed: Mar. 26, 2010

(65) Prior Publication Data

US 2011/0203870 A1 Aug. 25, 2011

Related U.S. Application Data

(60) Provisional application No. 61/307,983, filed on Feb. 25, 2010.

(51) Int. Cl.
*A62B 35/00* (2006.01)

(52) U.S. Cl. ..... 182/36; 248/228.4

(58) Field of Classification Search ..... 182/36; 248/228.1, 228.4

See application file for complete search history.

(56) References Cited

U.S. PATENT DOCUMENTS

| | | | | |
|---|---|---|---|---|
| 4,195,873 | A * | 4/1980 | Johnston | 294/106 |
| 4,606,430 | A * | 8/1986 | Roby et al. | 182/3 |
| 4,767,091 | A * | 8/1988 | Cuny | 248/228.4 |
| 5,271,481 | A * | 12/1993 | Rich | 182/3 |
| 5,325,788 | A | 7/1994 | Strickland et al. | |
| 5,526,896 | A * | 6/1996 | O'Rourke | 182/3 |
| 5,655,833 | A * | 8/1997 | Raczynski | 362/419 |
| 7,900,744 | B2 * | 3/2011 | McLaughin et al. | 182/36 |
| 2003/0006095 | A1 | 1/2003 | Desjardins | |

FOREIGN PATENT DOCUMENTS

| | | |
|---|---|---|
| DE | 295 17 560 U 1 | 1/1996 |
| GB | 2 389 386 A | 12/2003 |
| GB | 2 420 820 A | 6/2006 |

OTHER PUBLICATIONS

Uniline Safety Systems, MultiSafe UniRail. [online] [retrieved Jun. 30, 2010] Retrieved online at <URL: http://www.unilinesafety.com/Systems/MultiSafeUniRail/>.

International Search Report from PCT/US2011/024437 mailed May 24, 2011.

Kingspan Safetraxx Specification. Kingspan Saferidge Website. [online] [retrieved on Jun. 25, 2010] Retrieved from the internet: <URL: http://saferidge.com/safetraxx_spec.htm>.

* cited by examiner

*Primary Examiner* — Alvin Chin Shue
(74) *Attorney, Agent, or Firm* — IPLM Group, P.A.

(57) ABSTRACT

A fall protection system that includes at least one rail section, at least one shuttle and at least one connecting member is provided. The at least one rail section is configured and arranged to be coupled to a structure that changes in length. The at least one shuttle is configured and arranged to movably engage the at least one rail section. In addition, the at least one connecting member is configured and arranged to provide a connection point to the at least one shuttle.

18 Claims, 13 Drawing Sheets

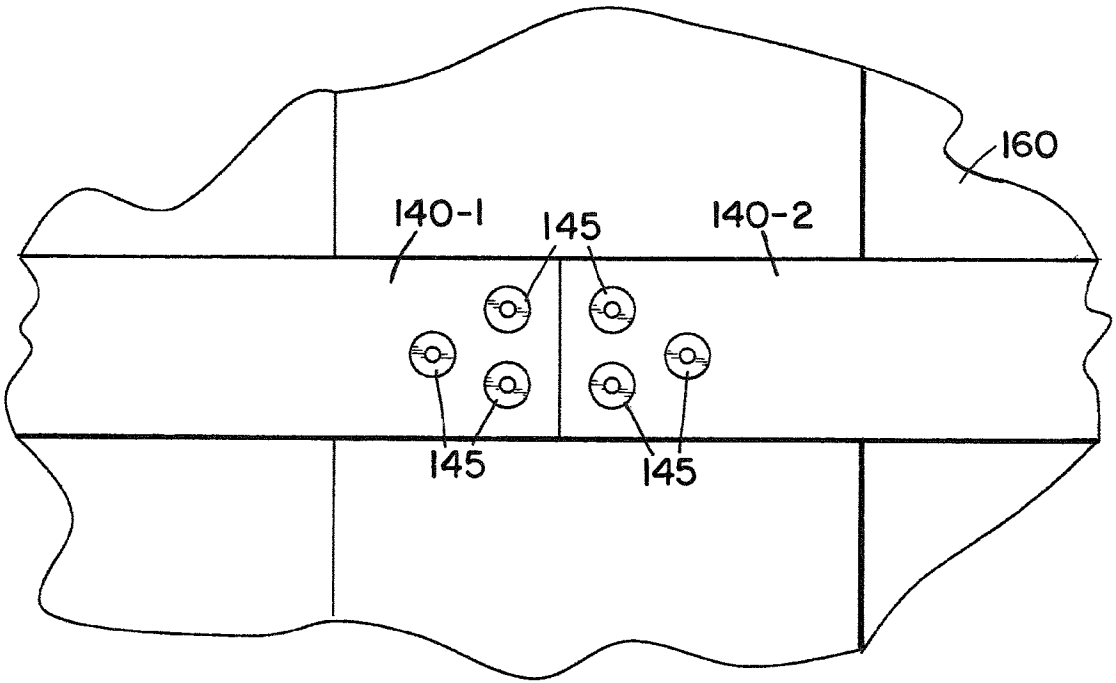
FIG.10A
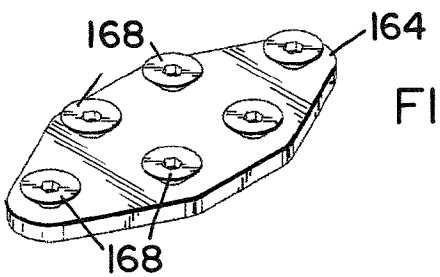
FIG.10C
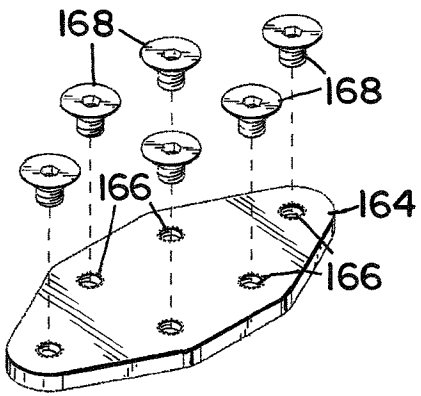
10B

JET BRIDGE FALL PROTECTION ASSEMBLY

CROSS-REFERENCE TO RELATED APPLICATIONS

This Application claims priority to U.S. Provisional Application Ser. No. 61/307,983, same title herewith, filed on Feb. 25, 2010, which is incorporated in its entirety herein by reference.

BACKGROUND

Fall protection and fall arrest systems that protect workers are used in work locations where a fall could cause injury or death. A typical fall arrest system includes a safety harness that is donned by the worker, a lifeline that is attached to the harness, and a support structure to which the lifeline is connected. This system works well in typical situations where a stationary stable support structure is available for attachment. However, it is desired in the art for a safety system where a stationary support is not available.

For the reasons stated above and for other reasons stated below which will become apparent to those skilled in the art upon reading and understanding the present specification, there is a need in the art for a protection assembly for workers required to work on an expanding and retracting housing without a stationary support structure available for use.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a fall protection system is provided. The fall protection system includes at least one rail section, at least one shuttle and at least one connecting member. The at least one rail section is configured and arranged to be coupled to a structure that changes in length. The at least one shuttle is configured and arranged to movably engage the at least one rail section. In addition, the at least one connecting member is configured and arranged to provide a connection point to the at least one shuttle.

BRIEF DESCRIPTION OF THE DRAWINGS

The present invention can be more easily understood and further advantages and uses thereof more readily apparent, when considered in view of the detailed description and the following figures in which:

FIG. 10A is a top view of the connection of two rails;

FIGS. 10B and 10C are illustration of mounting plates of one embodiment of the present invention used to couple sections of rails together;

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Figure 1:
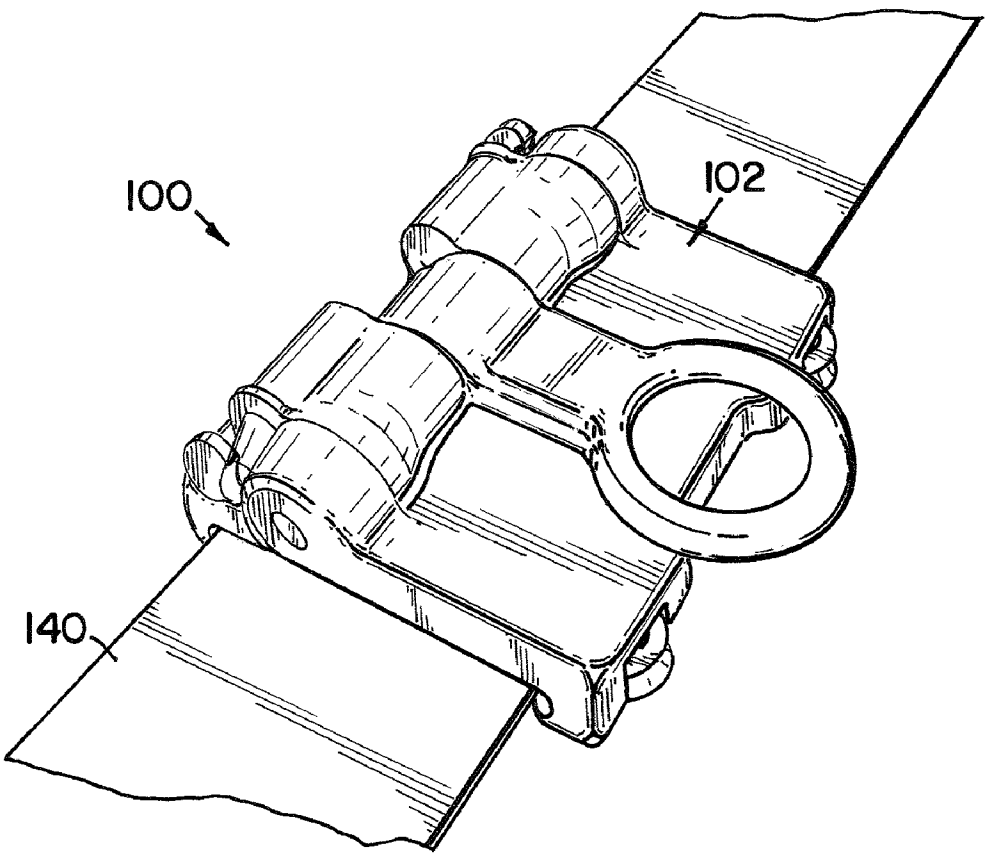
FIG. 1 is a top perspective view of a shuttle and rail of one embodiment of the present invention.
Figure 2:
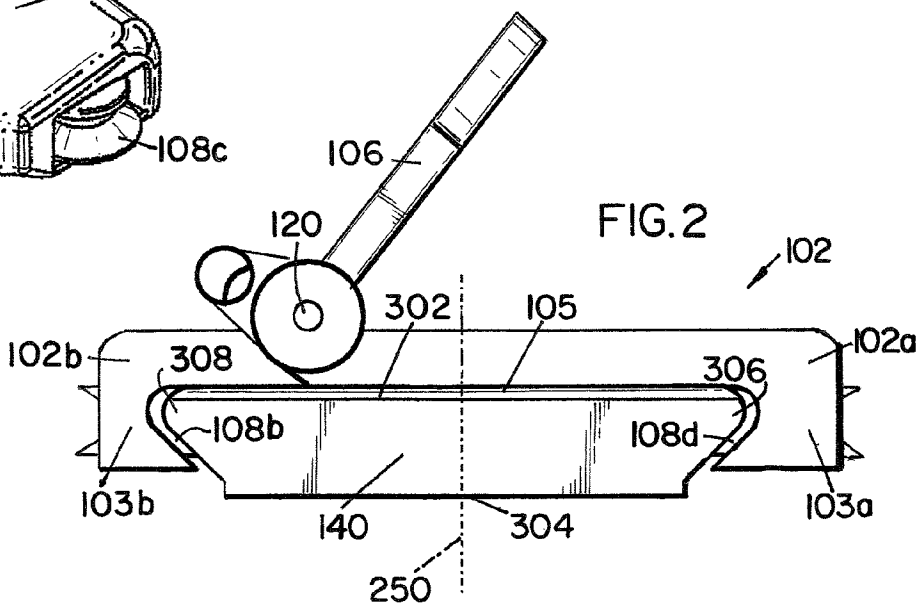
FIG. 2 is a side view of the shuttle and rail of FIG. 1.
Figure 3:
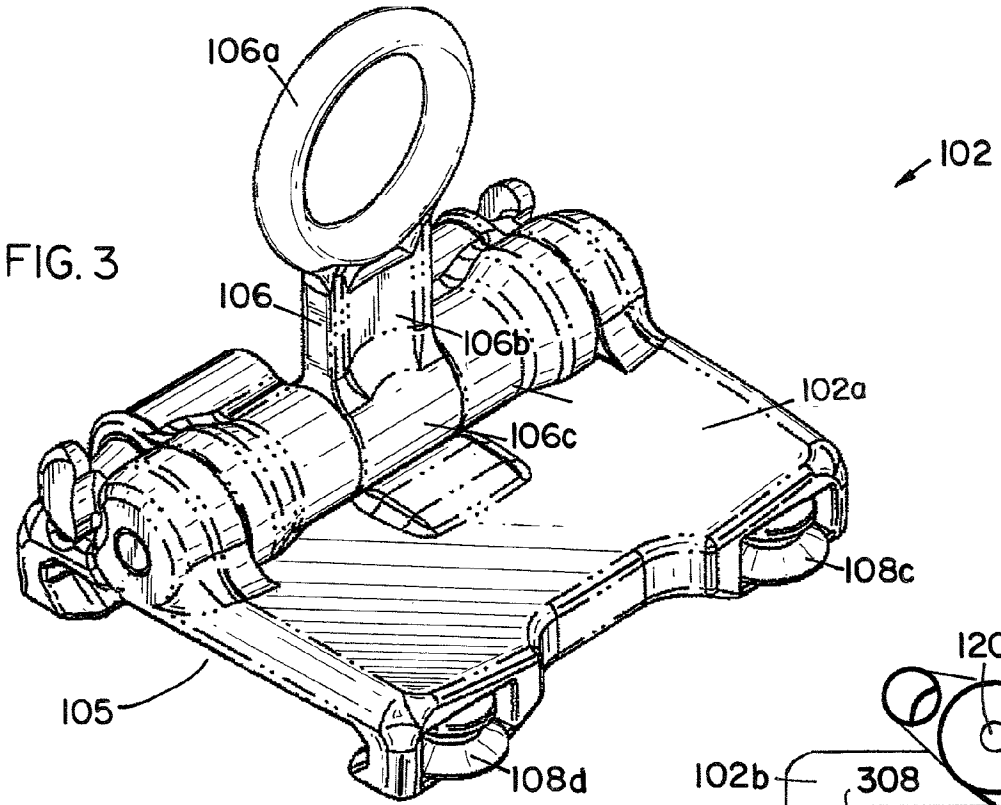
FIG. 3 is front perspective view of the shuttle of FIG. 1 with a connecting member in a connecting position.

Embodiments of the present invention provide a fall protection system for workers on structures that are adjusted in length such a jet bridge. In particular, embodiments provide rails 140 that are designed to not hamper the adjustment in length of the jet bridge 160 and shuttles 100 that are designed to slidably engage the rails 140. Referring to FIG. 1, an example of a fall protection system 100 of an embodiment includes a shuttle 102 that slidably engages a rail 140. A side view of the shuttle 102 on a rail 140 is further illustrated in FIG. 2. Detailed discussions of the elements of the shuttle 102 are provided below in regards to FIGS. 3 through 5. The shuttle 102 has three main parts, a main body portion 102*a*, a locking body portion 102*b* and a connecting member 106. The locking body portion 102*b* is pivotally coupled to the main body portion 102*a*. In use, the locking body portion 102*b* is designed to selectively pivot in relation to the main body portion 102*a* to couple the shuttle 102 to the rail 140. This is further discussed in detail in relation to FIGS. 6A through 6C below. The connecting member 106 is pivotally coupled the main and locking body portions 102*a* and 102*b*. The connecting member 106 is used to couple a snap hook or carabiner connected to a lifeline (not shown) to the shuttle 102. In FIG. 2, the shuttle 102 is locked on the rail 140. To lock the shuttle 102 on the rail 104, the main body portion 102*a* includes a first holding portion 103*a* and the locking body portion 102*b* includes a second holding portion 103*b*. The first holding portion 103*a* and the second holding portion 103*b* along with respective surfaces 212 and 247 of the respective main and locking body portions 102*a* and 102*b* (designated generally in FIG. 4) form a receiving track 105 that conforms to at least a portion of the shape of the rail 140 to retain the rail 140 in the receiving track 105.

Figure 7:
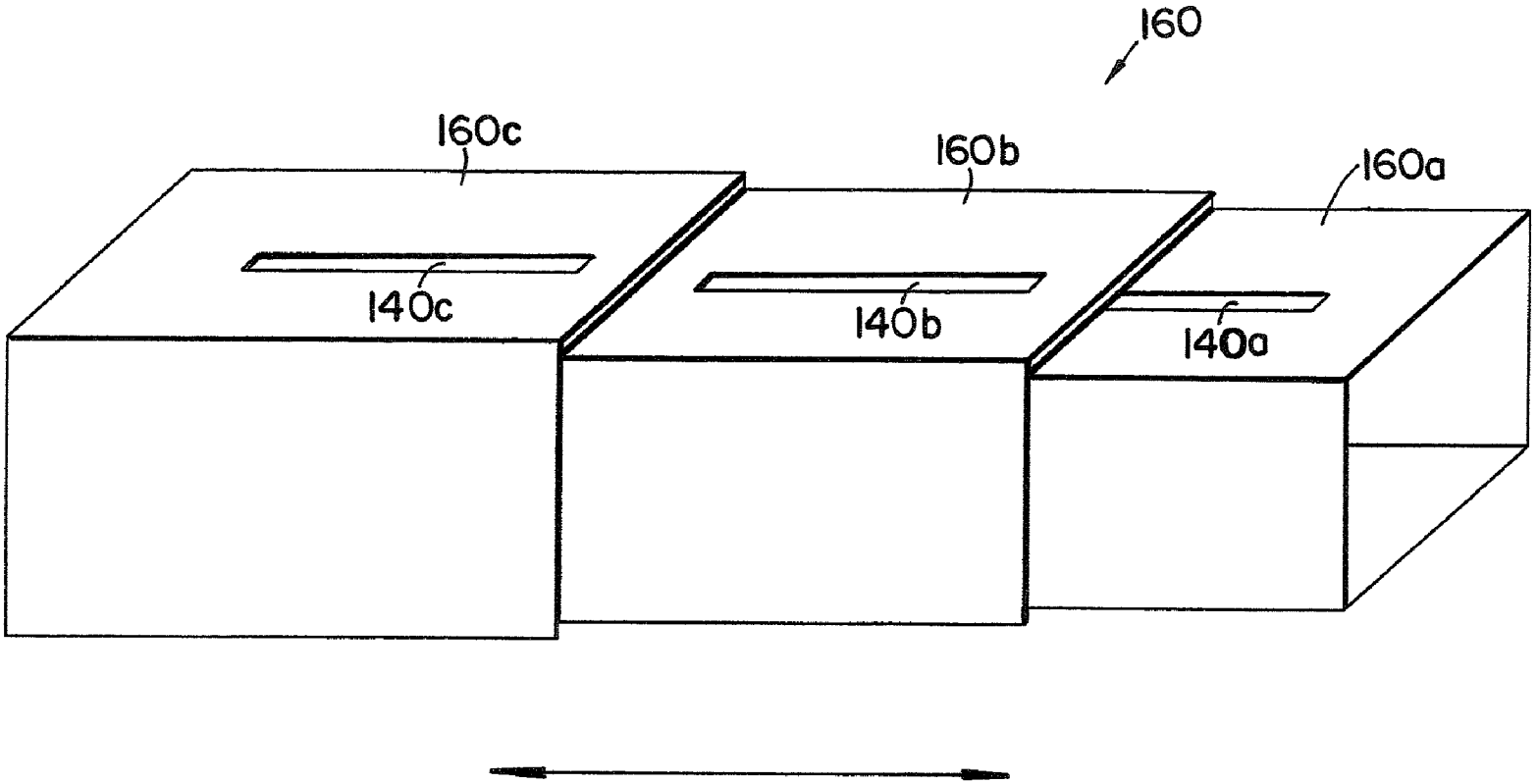
FIG. 7 is a side perspective view of a jet bridge including rail sections of one embodiment of the present invention.

The rail 140 is an elongated rail of a select length such as elongated rails 140*a*, 140*b* and 140*c* illustrated in FIG. 7. In one embodiment, the height of the rail 140 is less than 0.366 inch. The relatively short height of the rail 140 allows the rail 140 to be used in locations that have relatively small clearances such as jet bridges as discussed below. Referring back to FIG. 2, the elongated rail has a first surface 302, a second surface 304, a first edge 306 and second edge 308, the width of the rail 140 across the first surface 302 is greater than the width of the rail 140 across the second surface 140 such that both the first and second edges 306 and 308 of the rail 140 generally taper in from the first surface 302 to the second surface 304. The inner surfaces of the holding members 103*a* and 103*b* of the shuttle 102 conform to the shape of the respective first and second edges 306 and 308 of the rail 140 to retain the shuttle 102 on the rail 140. The shuttle 102 also includes rollers 108*a* through 108*d* (rollers 108*c* and 108*d* are illustrated in FIG. 2) that engage the shuttle 102. The rollers 108*a* through 108*d* help the shuttle 102 slide along the length of the elongated rail 140.

A center line 250 is also illustrated in FIG. 2. The center line 250 is on a midpoint along a length of the shuttle 102. The connecting member 106 of the shuttle 102 in embodiments is pivotally coupled via connecting rod 120 at a location that is at a select distance from the midpoint 250 of the shuttle 102. The overlap distance between the shuttle and rail can be improved by increasing the distance between the rotating axis and centerline. This allows for higher forces and higher torque values on the shuttle during a fall. The pivot connection (i.e. connection rod) 120 is generally parallel to the central line. In this configuration, during a fall event, forces asserted on the shuttle 102 proximate the pivot connection will not overcome the holding forces of the holding members 103*a* and 103*b* that engage the respective first and second edges 306 and 308 of the rail 140 to pull the shuttle 102 off the track 140. Hence, off centering the pivot connection of the connecting member 106 from a midpoint of the shuttle 102 helps retain the shuttle 102 on the track 140 during a fall event.

Figure 4:
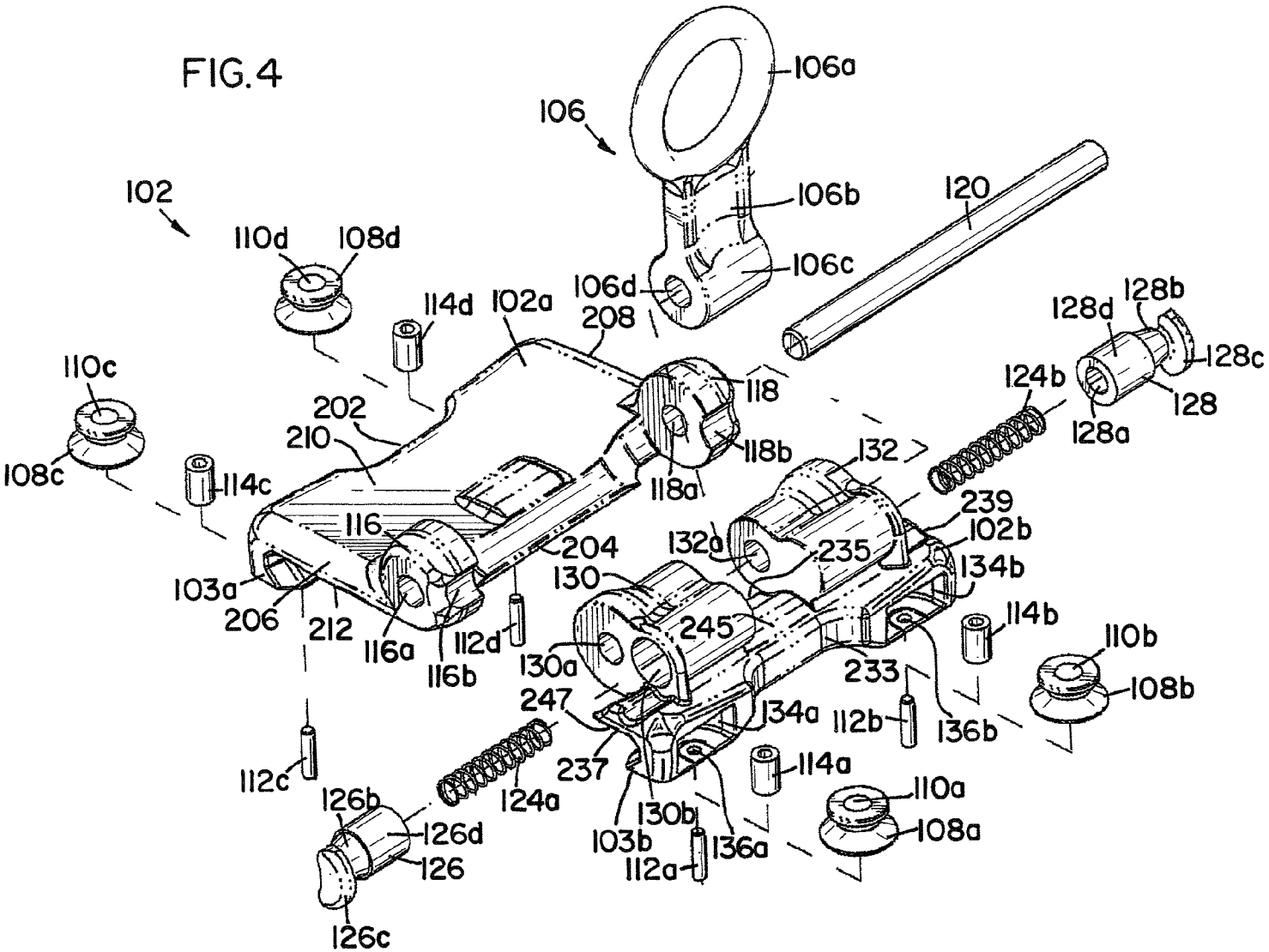
FIG. 4 is an exploded side perspective view of the shuttle of FIG. 3.

Referring to the exploded view of shuttle 102 in FIG. 4, further discussion of the shuttle 102 is provided. As discussed above, the shuttle 102 includes a main body portion 102*a*. The main body portion 102*a* has a first side 202, a second side 204, a first end 206, a second end 208, a first surface 210 and a second surface 212. A first connector 116 (or main connector) extends from the main body member 102*a* proximate a first corner of the main body member 102*a*. The first corner of the main body member 102*a* is a corner defined where the first end 206 and the second side 204 of the main body member 102*a* meet. The first connector 116 has a first connector passage 116*a* that passes through the first connector 116. The first connector 116 is generally cylindrical in shape in an embodiment and has a first C-shaped groove 116*b* formed in a portion of its surface as illustrated in FIG. 4.

A second connector 118 extends from the main body member 102*a* proximate a second corner of the main body member 102*a*. The second corner is a corner defined where the second end 208 and the second side 204 of the main body member 102*a* meet. The second connector 118 has a second connector passage 118*a* that passes through the second connector 118. The first connector passage 116*a* and the second connector passage 118*a* are aligned. The second connector 118 is generally cylindrical in shape in an embodiment and has a second C-shaped groove 118*b* formed in a portion of its surface as illustrated in FIG. 4. The first C-shaped groove 116*b* of the first connector 116 is aligned with the second C-shaped groove 118*b* in the second connector 118 in an embodiment. The first holding portion 103*a* extends along the first side 202 of the main body portion 102*a* beyond the second surface 212 of the main body portion 102*a*. The first holding portion 103*a* conforms to the shape of a portion of the rail 140 as discussed above. In one embodiment the shape of the first holding portion 103*a* and the second surface 212 is generally C-shaped along the first side 202 of the main body portion 102*a*.

The locking body portion 102*b* has a first side 233, a second side 235, a first end 237, a second end 239, a first surface 245 and a second surface 247. A third connector 130 (or locking connector) extends from the locking body portion 102*b* proximate the second side 235 and the first end 237 of the locking body portion 102*b*. The third connector 130 is generally cylindrical in shape and has a third connector passage 130*a* that passes through the third connector 130. A fourth connector 132 extends from the locking body portion 102*b* proximate the second side 235 and the second end 239 of the locking body portion 102*b*. The fourth connector 132 is generally cylindrical in shape and has a fourth connector passage 132*a* that passes through the fourth connector 132. The first connector passage 116*a* of the first connector 116 and the second connector passage 118*a* of the second connector 116 of the main body portion 102*a* are aligned with the third connector passage 130*a* and the fourth connector passage 132*a* of the third and fourth connectors 130 and 132 of the locking body portion 102*b*. A connection rod 120 is received in the first connector passage 116*a* of the first connector 116, in the second connector passage 118*a* of the second connector 118, in the third connector passage 130*a* of the third connector 130 and in the fourth connector passage 132*a* of the fourth connector 132 to pivotally connect the main body portion 102*a* to the locking body portion 102*b*.

The third connector 130 further includes a first locking portion with a cylindrical first locking chamber 130*b* that has an opening facing the first end 237 of the locking body portion 102*b*. A first locking member 126 has a first barrel portion 126*d* that is slidably received in the first locking chamber 130*b* of the first locking portion of the third connector. The first locking member 126 further has a first engagement portion 126*c* and a first recessed portion 126*b* positioned between the first barrel portion 126*d* and the first engagement portion 126*c* of the first locking member 126. A first biasing member 124*a* is positioned in the first locking chamber 130*b* and a bore (not shown) in the first barrel portion 126*d* of the first locking member 126. The first biasing member 124*a* provides a first biasing force to bias the first locking member 126 such that the first barrel portion 126*d* is received in first groove 116*b* of the first connector 116 of the main body portion 102*a* thereby locking the main body portion 102*a* and the locking body portion 102*b* in a static configuration in relation to each other. Further when the first engaging portion 126*c* of the first locking member 126 is pressed, the biasing member 124*a* is compressed allowing the first recessed portion 126*b* to align with the first groove 116*b* of the first connector 116 of the main body portion 102*a* such that the first barrel 126*d* of the first locking member 126 is no longer received in the first groove 116*b* of the first connector 116 of the main body portion 102*a*.

The fourth connector 132 further includes second locking portion with a cylindrical second locking chamber (not shown) that has an opening facing the second end 239 of the locking body portion 102*b*. A second locking member 128 has a second barrel portion 128*d* that is slidably received in the second locking chamber of the second locking portion of the fourth connector 132. The second locking member 128 further has a second engagement portion 128*c* and a second recessed portion 128*b* positioned between the second barrel portion 128*d* and the second engagement portion 128*c* of the second locking member 128. A second biasing member 124*b* is positioned in the second locking chamber and bore 128*a* in the second barrel portion 128*d* of the second locking member 128. The second biasing member 124*b* provides a second biasing force to bias the second locking member 128 such that the second barrel portion 128*d* is received in second groove 118*b* of the second connector 118 of the main body portion 102*a* thereby locking the main body portion 102*a* and the locking body portion 102*b* in a static configuration in relation to each other. Further when the second engaging portion 128*c* of the second locking member 128 is pressed, the biasing member 124*b* is compressed allowing the second recessed portion 128*b* to align with the second groove 118*b* of the second connector 118 of the main body portion 102*a* such that the second barrel 128*d* of the second locking member 128 is no longer received in the second groove 118*b* of the second connector 118 of the main body portion 102*a*. Hence, when both the first engaging portion 126*c* and the second engaging portion 128*c* of the respective first and second locking members 126 and 128 are depressed simultaneously, the locking body portion 102*b* is allowed to pivot in relation to the main body portion 102*a* about the connection rod 120. Moreover, when the first barrel portion 126*d* and the second barrel portion 128*d* of the respective first and second locking members 126 and 128 are in the respective first and second grooves 116*b* and 118*b* of the first connector 116 and the second connector 118, the main body portion 102*a* is locked in a static position in relation to the locking body portion 102*b*.

In the locked position, the second surface 212 and the first holding portion 103*a* of the main body portion 102*a* and the second surface 247 and the second holding portion 103*b* form the receiving track 105 configured to envelope the rail 140. As discussed above, the second holding portion 103*b* extends along the first side 233 of the locking body portion 102*b* beyond the second surface 247 of the locking body portion 102*b*. The second holding portion 103*b* and the second surface 247 forms generally a C-shape in this embodiment along the first side 233 of the locking body portion 102*b* which along with the first holding portion 103*a* and the second surface 212 of the first holding portion form the receiving track 105.

As briefly discussed above, the shuttle further includes rollers 108*a* through 108*d* to enhance the slidability of the shuttle 102 on the rail 140. In particular, the first side 233 of the locking body portion 102*b* includes first and second openings to roller passages 134*a* and 134*b*. The roller passages 134*a* and 134*b* pass through the second holding portion 103*b* into the receiving track 105. Retaining bores 136*a* and 136*b* are formed in the second holding portion 103*b*. The retaining bores 136*a* and 136*b* extend to the respective roller passages 134*a* and 134*b* in generally a perpendicular manner. A first roller 108*a* is received in roller passage 134*a* and a second roller 108*b* is received in roller passage 134*b* such that a portion of each of the first and second rollers 108*a* and 108*b* extend into the receiving track 105 to engage a side portion of the rail 140 that is received in the receiving track 105. The first roller 108*a* has a first roller central passage 110*a*. A first bearing 114*a* is received in the first roller central passage 110*a*. The first bearing 114*a* further has a first bearing central passage in which a first retaining pin 112*a* passes therethrough and is positioned in retaining bore 136*a* to retain the first roller 108*a* in roller passage 134*a*. The second roller 108*b* has a second roller central passage 110*b*. A second bearing 114*b* is received in the second roller central passage 110*b*. The second bearing 114*b* further has a second bearing central passage in which a second retaining pin 112*b* passes therethrough and is positioned in retaining bore 136*b* to retain the second roller 108*b* in roller passage 134*b*. The third and fourth rollers 108*c* and 108*d* are similarly received in roller passages through the first holding portion 103*a* of the main body member 102*a*. In particular, first and second bearings 114*c* and 114*d* are received in respective third and fourth central passages 110*c* and 110*d* and retaining pins 112*c* and 112*d* passing through respective retaining bores (not shown) rotationally mount the third and fourth rollers 108*c* and 108*d* in the roller passages such that a portion of each third and fourth roller 108*c* and 108*d* engages a side portion of the rail 140 received in the receiving track 105 formed by the main and locked body portions 102*a* and 102*b*.

The connection member 106 includes a base portion 106*c* having a connecting member passage 106*d*. The base portion 106*c* is positioned between the third and fourth connectors 130 and 132 of the locking body portion 102*b*. The connecting member passage 106*d* of the base portion is aligned with the first connector passage 116*a* of the first connector 116 and the second connector passage 118*a* of the second connector 116 of the main body portion 102*a* and the third connector passage 130*a* and the fourth connector passage 132*a* of the locking body portion 102*b*. The connecting rod 120 passes through the connecting member passage 106*d* of the connecting member 106 providing a pivot connection between the connecting member 106 and the main body portion 102*a* and the locking body portion 102*b*. The connecting member 106 further has a connecting looped portion 106*a* designed to engage a snap hook, carabiner or the like that is attached to a safety harness of a user via a lifeline. Hence, the connecting looped portion 106*a* provides a connection point to the shuttle 102. The connecting member 106 further has an elongated portion 106*b* that connects the base portion 106*c* to the looped portion 106*a*.

Figure 5:
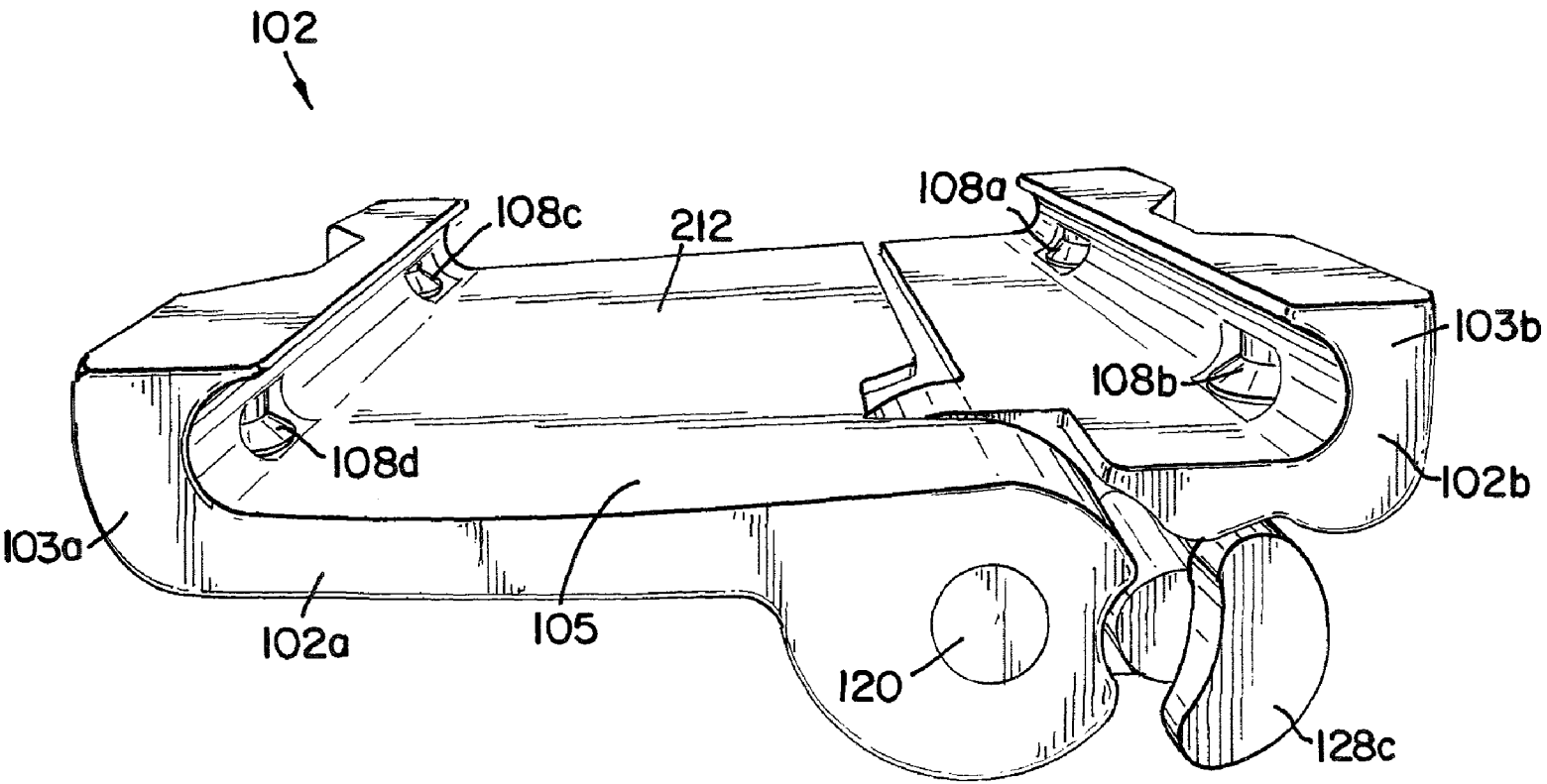
FIG. 5 is a bottom perspective view of the shuttle of FIG. 3.
Figure 6A:
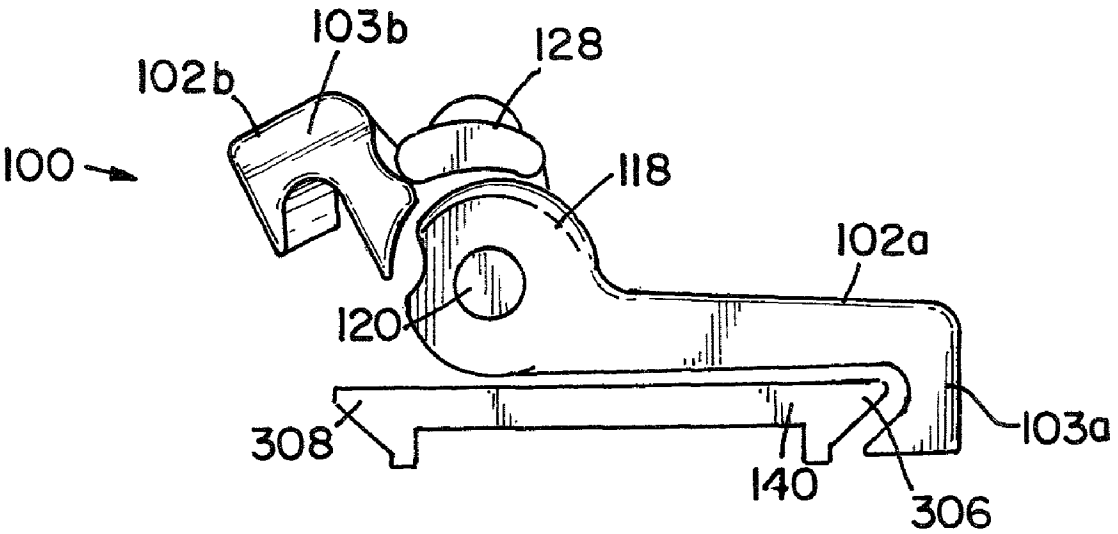
FIGS. 6A through 6C are side view illustrations of how the shuttle attaches to the rail of FIG. 1.
Figure 6B:
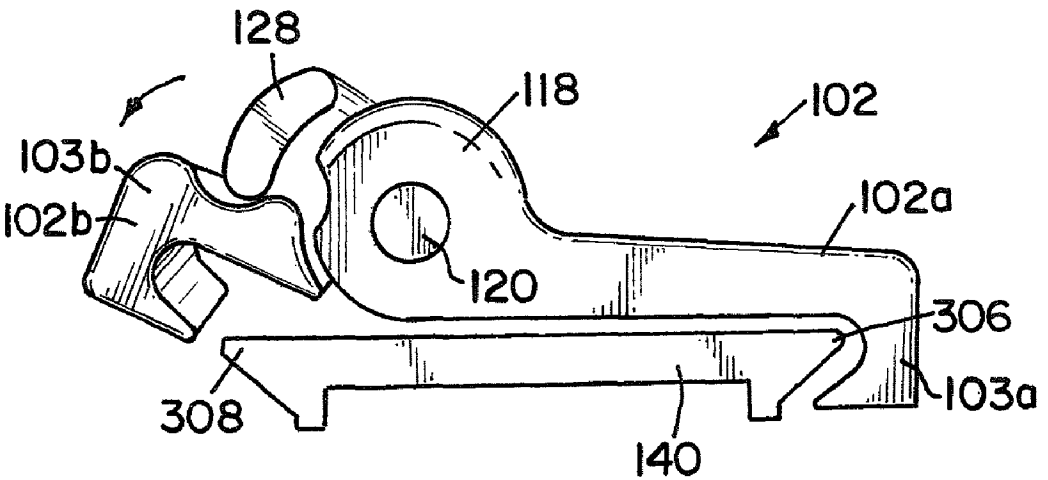
Figure 6C:
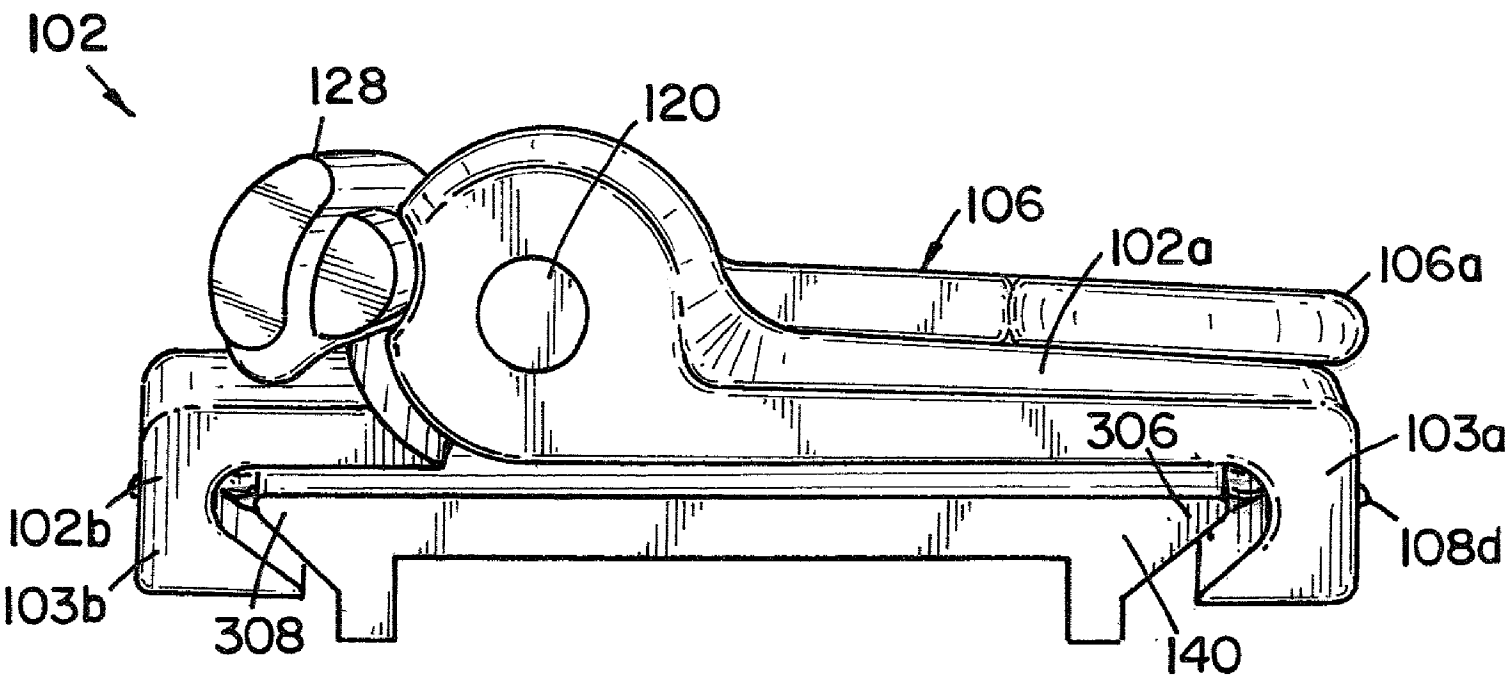

FIG. 5 is a bottom perspective view of the shuttle 102 further illustrating the receiving track 105 formed when the shuttle 102 is in a locked position. Also illustrated are portions of rollers 108*a* through 108*d* extending into the receiving track portion 105. FIGS. 6A through 6C illustrate how the shuttle 102 is attached to the rail 140. In FIG. 6A, both first and second locking members 126 and 128 (not shown in this Figure) have been simultaneously depressed thereby allowing the locking body portion 102*b* to pivot in relation to the main body portion 102*a*. In the position illustrated in FIG. 6A, the main body portion 102*a* is placed on rail 140 so the first holding portion 103*a* envelopes the first edge 306 of the rail 140. Once, the main body portion 102*a* is positioned, the locking body portion 102*b* is rotated towards the rail 140 as illustrated in FIG. 6B. The locking body portion 102*b* is rotated until the barrels 126*d* and 128*d* of the first and second locking members 126 and 128 are received in the respective first and second grooves 116*b* and 118*b* in the respective first and second connectors 116 and 118. In this position, the second holding member 103*b* engages the second edge 308 of the rail 140 thereby locking the shuttle 102 on the rail 140, as illustrated in FIG. 6C. To remove the shuttle 102, the first and second locking member 126 and 128 are simultaneously depressed, thereby releasing the second holding member 103*b* of the locking body portion 102*b* from the second edge 308 of the rail 140.

Figure 8A:
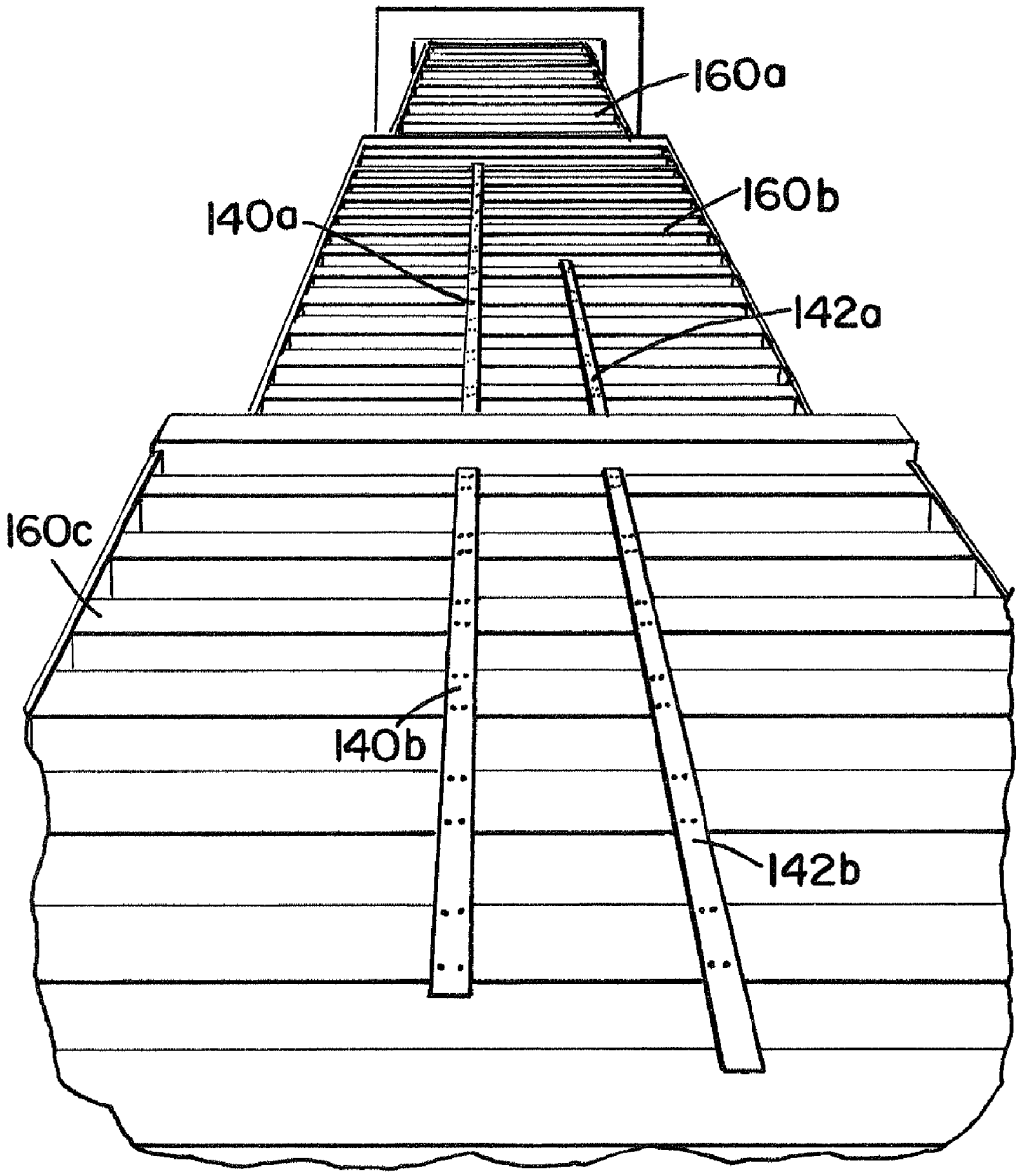
FIG. 8A is a top perspective view of a jet bridge with a plurality of rails of one embodiment of the present invention.
Figure 8B:
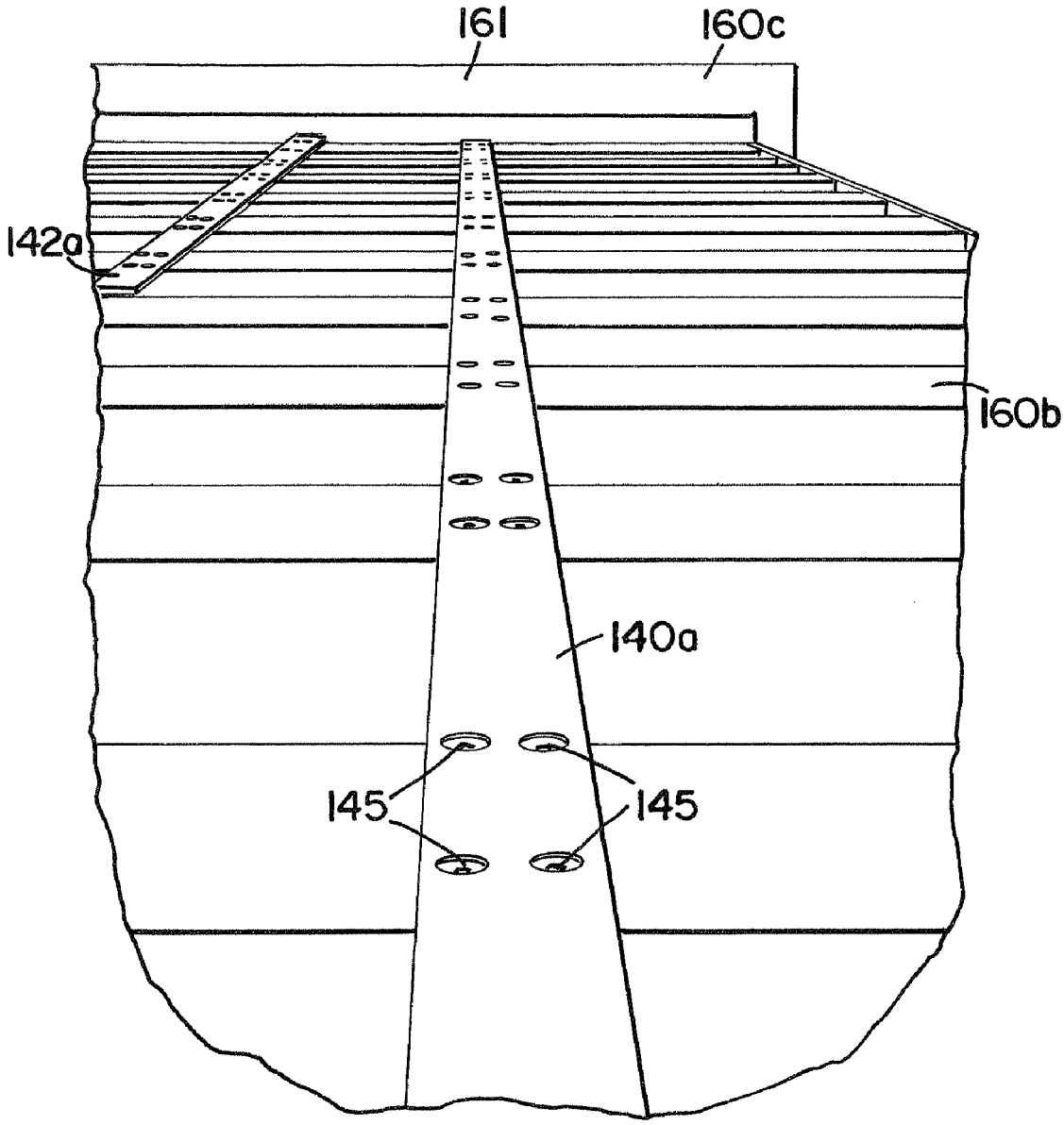
FIG. 8B is a close up top perspective view of rails of one section of jet bridge being received in another section of jet bridge.

As briefly discussed above, FIG. 7 is a side perspective view of a structure 106 that changes in length such as a jet bridge. The jet bridge 160 in this example has three sections 160*a*, 160*b* and 160*c*. Section 160*a* is designed to slide into and out of section 160*b*. Similarly, section 106*b* is configured to slide into and out of section 160*c*. Hence, the overall length of the jet bridge 160 can be adjusted by the positioning of the sections 160*a*, 160*b* and 160*c* in relation to each other. Also illustrated in FIG. 7, are rail sections 140*a*, 140*b* and 140*c* that are coupled to the top of the respective jet bridge sections 160*a*, 160*b* and 160*c*. Each rail section 140*a*, 140*b* and 140*c* may be made of a plurality of rail subsections that are coupled together as illustrated in FIG. 10A and described below to foam the respective rail sections 140*a*, 140*b* and 140*c*. FIG. 8A is a top view of a jet bridge having sections 160*a*, 160*b* and 160*c*. In this example embodiment, two sets of rails are used. In particular, a first rail system includes sections 140*a* and 140*b* and a second rail system includes 142*a* and 142*b*. Hence, embodiments allow for more than one rail system. Moreover, in one embodiment, each rail section 140*a*, 140*b*, 142*a* and 142*b* are made from a material that has sufficient strength to hold more than one user during multiple fall events. Example materials used include, but are not limited to aluminum alloys such as 6061-T6 and 7075-T6, or stainless steels. Referring to FIG. 8B a close up top perspective view of rails 140*a* and 142*a* connected to section 160*b* of the jet bridge with fasteners 145 is illustrated. FIG. 8B also illustrates how the rails 140*a* and 142*a* that are connected to section 160*b* fit under a top portion 161 of section 160*c* so as to not hamper the movement of the respective sections 160*a*, 160*b* and 160*c* in relation to each other. Hence, this is one reason the rail 140 is designed to have a relatively short height.

Figure 9:
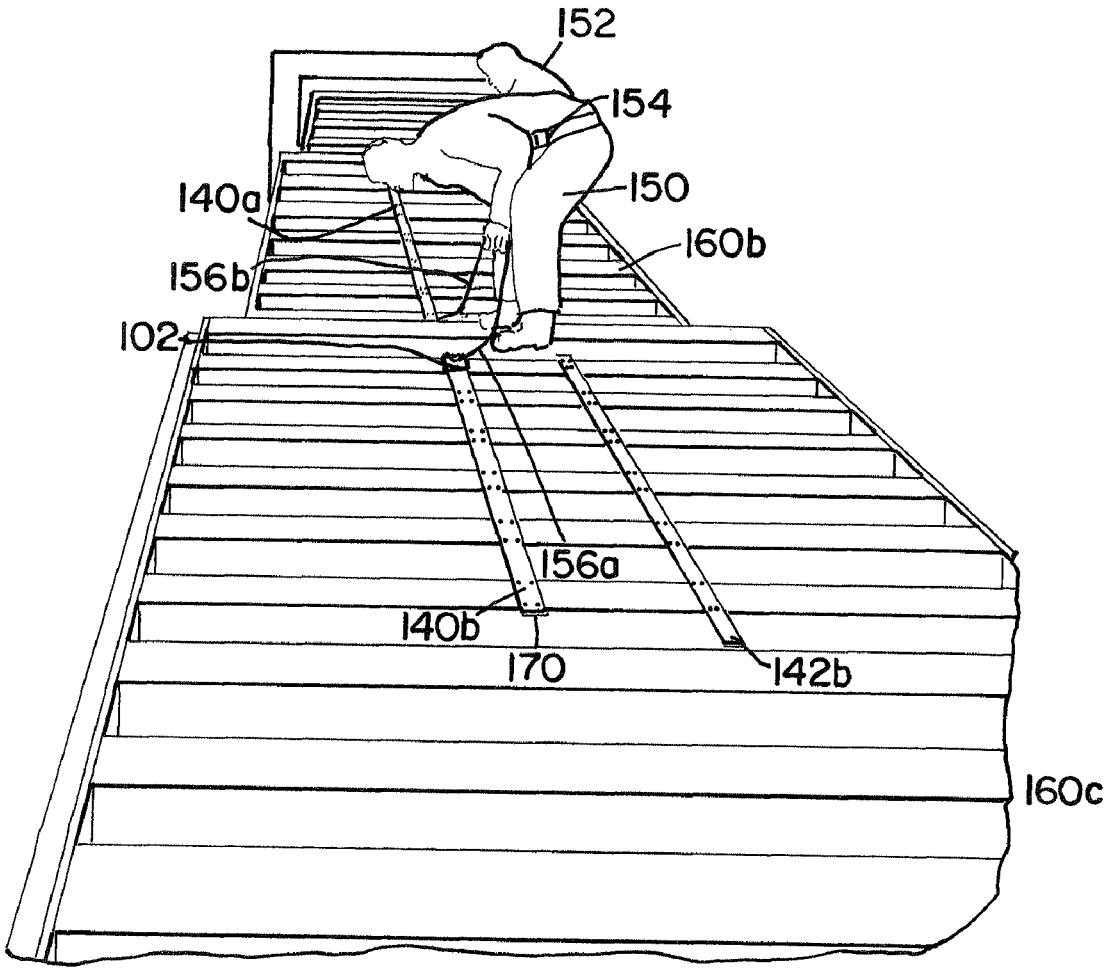
FIG. 9 is a top view of a jet bridge with workers operatively connected to rails.

FIG. 9 illustrates two workers 152 and 154 (or users) coupled to the two different rail systems 140*a*, 140*b* and 142*a* and 142*b*. In typical use, a worker will have two separate shuttles 102 coupled to their respective safety harness. When a worker 154 needs to move from one section 160*c* to another section 160*b* of the bridge, the worker simply attaches a second one of his or her shuttles 102 to the rail 140*a* that is coupled to the section 106*b* of the jet bridge the worker wants to move to when the respective rail 140*a* is within the workers reach. Once the second one of the shuttle 102 is connected to rail 140*a*, the worker's first shuttle 102 is then unlocked and detached from the rail 140*b* attached to the section 106*c* of the jet bridge the worker is leaving. This way the worker 154 is always attached to a lifeline.

The length of each rail can be extended by using more than one rail section or sub-section. For example, referring to FIG. 10A a top view of two rail sub-sections 140-1 and 140-2 coupled together is illustrated. An attaching plate 164, as illustrated in FIGS. 10B and 10C, is used to couple the rail sub-sections 140-1 and 140-2 together. In particular, plate 164 is positioned on an inside surface of a top portion 161 of a jet bridge section 160. Plate 164 is coupled to the respective rails 104-1 and 140-2 via fasteners passing through plate apertures 166, apertures in the top portion 161 of the jet bridge section 160. Fasteners 145 passing through rail sections 140-1 and 140-2 threadably engage fasteners 168 to couple the rail sub-section 104-1 and 140-2 together. Plate 164 is relatively thin so as to not hamper the retraction and extension of sections of the jet ramp bridge.

Figure 11A:
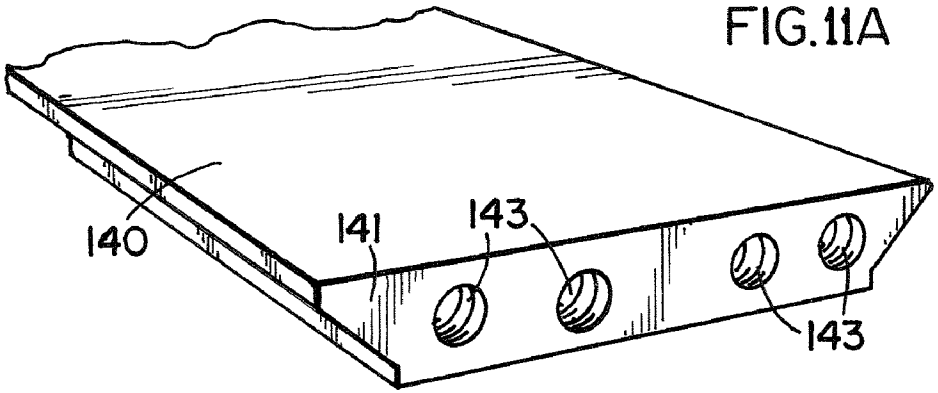
FIG. 11A is a view of a back end section of rail of one embodiment of the present invention.
Figure 11B:
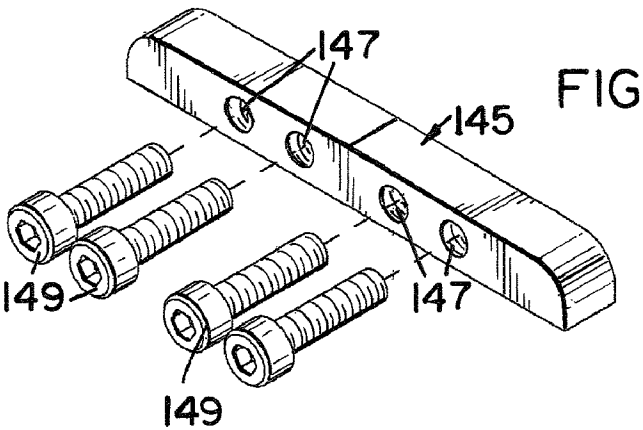
FIG. 11B is an end perspective view of a backend stop of one embodiment of the present invention.

To make sure the shuttle does not run off an end of a rail 140, rail stops are used. In particular backend stops 145 are used for back ends 141 of a rail 140 and frontend stops 180 are used for a front ends 179 of a rail 140 in an embodiment. Referring to FIG. 11A, a back end of rail 140 is illustrated. The back end includes threaded apertures 143. A backend stop 145 is further illustrated in FIG. 11B. Fasteners 149 having external threads pass through apertures 147 in the backend stop 145 and threadably engage threaded bores 143 in the back end 141 of the rail 140 to couple the backend stop 145 to the rail 140. The backend stop 145 prevents the shuttle 102 from coming off the back end 141 of the rail 140. In embodiments, the backend stop 145 and the connection to the rail are designed strong enough so that the shuttle 102 will remain on the rail 140 during a fall event that exerts forces on the backend stop 145.

Figure 12A:
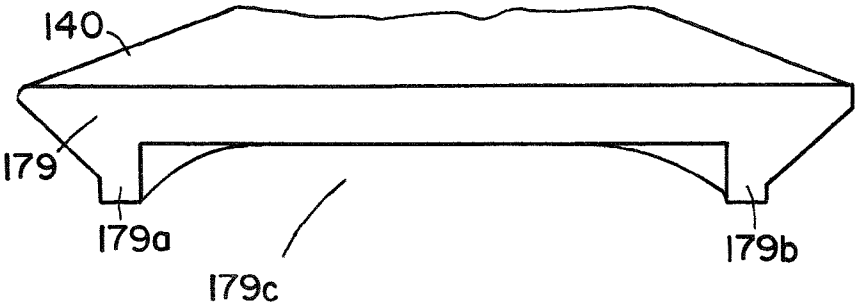
FIG. 12A is a view of a front end section of a rail of one embodiment of the present invention.
Figure 12C:
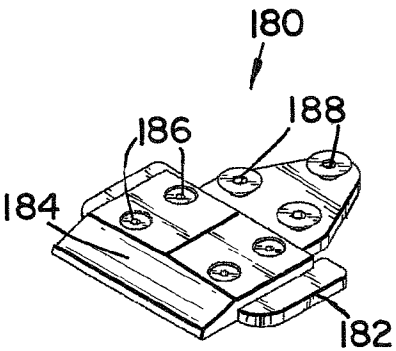
FIG. 12C is a front perspective view of an assembled frontend stop of FIG. 12B.
Figure 12B:
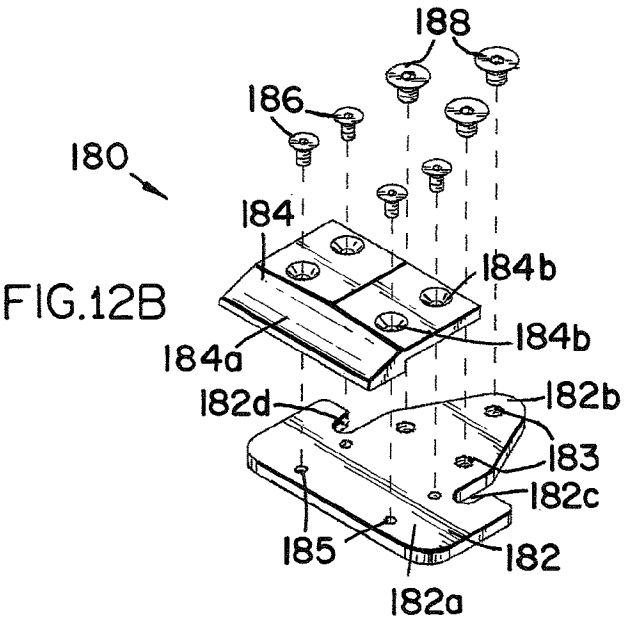
FIG. 12B is a front perspective view of an exploded frontend stop of one embodiment of the present invention.

A front end 179 of a rail 140 is illustrated in FIG. 12A. The front end 179 of the rail 140 also includes a stop as stated above. In particular, a frontend stop 180 is illustrated in FIGS. 12B and 12C. The frontend stop 180 includes a base plate 182 and a ramp plate 184. The base plate 182 has a first portion 182*a* and a second portion 182*b*. The first portion 182*a* has a plurality of apertures 185. Fasteners 186 passing through apertures 184*b* in the ramp plate 184 are used to couple the ramp plate 184 to the first portion 182*a* of the base plate 182 via apertures 185. The ramp plate 184 includes a ramp surface 184 that is designed so that the frontend stop 180 with not get caught on any part of a section 160 of a jet bridge when the jet bridge is retracting. The second portion 182*b* of the base plate 183 extends from the first portion 182*a* and is designed to fit in a slot 179*c* in the front end 179 of the rail 140. In addition, feet sections 179*a* and 179*b* of the front end 179 of the rail 140 are designed to be received in slots 182*c* and 182*d* of the base plate 182. Fasters 188 pass through apertures in the rail and threadably engage threaded apertures 182*c* in the second section 182 of the base plate 182 to couple the frontend stop 180 to the front end 179 of the rail 140. Similar to the construction of the backend stop 145 of the rail, the front end stop 180 is designed to be strong enough to retain the shuttle on the rail 140 during a fall event that exerts forces on the frontend stop 180.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A fall protection system comprising:

at least one rail section configured and arranged to be coupled to a structure that changes in length;

at least one shuttle configured and arranged to slidably engage the at least one rail section; the at least one shuttle including, a main body portion having at least one main body connector, the at least one main body connector having a locking groove, a locking body portion having at least one locking body connector, the locking body connector of the locking body portion pivotally coupled to the at least one main body connector of the main body portion, the locking body connector including a locking body chamber, at least one locking member at least partially received in the locking body chamber of the at least one locking body connector of the locking body portion, the locking member having a barrel portion, a recessed portion and a bore in an end of the locking member, a biasing member for each locking member, the biasing member at least partially received in the bore of the locking member, the biasing member configured and arranged to bias the locking member so that the barrel portion of the locking member is received in the locking groove of the at least one main body connector to lock the locking body portion in a static configuration in relation to the main body portion; and at least one connecting member configured and arranged to provide a connection point to the at least one shuttle.

2. The fall protection system of claim 1, further comprising:

at least one end stop configured and arranged to prevent the at least one shuttle from sliding off of an end of the at least one rail section.

3. The fall protection system of claim 1, wherein each rail section further comprises:

opposed first and second edges and opposed first and second surfaces, a height of the rail defined by the distance between the first surface and the second surface, the first surface having a first width defined by the distance between the first and second edges, the second surface having a second width defined by the distance between the first and second edges, wherein the first and second edges taper in from the first surface to the second surface, the second surface configured and arranged to engage a surface of the structure.

4. The fall protection system of claim 3, wherein the height of the rail is less than 0.366 of an inch.

5. The fall protection system of claim 3, wherein the at least one shuttle further comprises:

the main body portion having opposed first and second sides, the main body portion having a first holding member extending along the first side of the main body portion, the first holding portion configured and arranged to fit around the first edge of the at least one rail section; and the locking body portion having opposed first and second sides, the first side of the locking body portion pivotally coupled to the second side of the main body portion, the locking body portion having a second holding member extending along the second side of the locking body portion, the second holding member configured and arranged to fit around the second edge of the at least one rail section, the shuttle forming a receiving track portion configured and arranged to receive the at least one rail section.

6. The fall protection system of claim 5, further comprising:

at least one main body roller rotationally coupled to the first holding member of the main body portion, wherein the at least one main body roller is configured and arranged to engage the first edge of the at least one rail to enhance movement of the at least one shuttle along the at least one rail; and at least one locking body roller rotationally coupled to the second holding member of the locking body portion, wherein the at least one locking body roller is configured and arranged to engage the second edge of the at least one rail to enhance movement of the at least one shuttle along the at least one rail.

7. The fall protection assembly of claim 1, further comprising:

at least one end stop coupled to at least one end of the at least one elongated rail to prevent the shuttle from sliding off an end of the at least one elongated rail.

8. The fall protection assembly of claim 7, wherein the at least one end stop is a backend stop configured and arranged to be engaged with a respective end of the at least one elongated rail.

9. The fall protection assembly of claim 7, wherein the at least one end stop is a frontend stop, the frontend stop including a ramp portion configured and arranged to prevent an end of an associated elongated rail from catching up on a retracting section of the structure.

10. A fall protection assembly comprising:

at least a first elongated rail configured and arranged to be coupled along a length of a first structure;

at least a second elongated rail configured and arranged to be coupled along a length of a second structure, wherein the second structure is slidably received within the first structure; and at least one shuttle configured and arranged to slidably engage at least one of the at least one first elongated rail and the at least one second elongated rail, each shuttle including, a main body portion, a locking body portion pivotally coupled to the main body portion, the locking body portion configured to selectively pivot in relation to the main body portion to selectively engage and disengage the at least one elongated member, and a connecting member pivotally coupled to the main body portion configured and arranged to provide a connection point to the at least one shuttle, wherein the at least one shuttle further comprises:

the main body portion including a pair of main body connectors, the pair of main body connectors having aligned body connector passages, each main body connector further having a connection groove;

the locking body portion including a pair of locking body connectors, the pair of locking body connectors having aligned locking connector passages, each locking body connector positioned adjacent a respective main body connector of the main body portion with the locking connector passages of the locking body connectors aligned with the body connector passages of the main body connectors, each locking body connector further having a locking body chamber;

a connection rod received in the body connector passages and locking connector passages to pivotally couple the main body portion to the locking body portion;

a locking member for each locking body connector, each locking member having a first end and a second end, each locking member further having an engaging portion proximate the first end, a barrel portion proximate the second end and a recessed portion positioned between the engaging portion and the barrel portion, at least a first portion of the barrel portion of each locking member configured and arranged to be slidably received in a locking body chamber of a respective locking body connector;

a biasing member for each locking member, each biasing member configured and arranged to bias a respective locking member so that the barrel portion of a respective locking member is received in a respective connection groove of a respective main body connector of the main body portion to lock the locking body portion in a static position in relation to the main body portion; and the connecting member pivotally coupled to the main body portion via the connection rod.

11. The fall protection assembly of claim 10, the at least one shuttle further comprising:

the main body portion including a first side, a second side, a first surface and a second surface, the main body portion further including, a first holding portion extending along the first side of the main body portion beyond the second surface of the main body portion, the first holding portion configured to envelope a first edge of the at least one track member; and the locking body portion including a first side, a second side, a first surface and second surface, the locking body portion further including, a second holding portion extending along the first side of the locking body portion beyond the second surface of the locking body portion, the second holding portion configured to selectively envelope a second edge of the at least one track member, wherein the first holding portion and the second surface of the main body portion and the second holding portion and the second surface of the locking body portion selectively form a receiving track to receive the at least one elongated rail.

12. The fall protection assembly of claim 11, wherein the connecting member extends from the first surface of the main body portion.

13. The fall protection assembly of claim 12, wherein the at least one shuttle has a midpoint halfway between the first holding portion of the main body portion and the second holding portion of the locking body portion, the connecting member coupled to the shuttle at a select distance away from the midpoint.

14. The fall protection assembly of claim 10, wherein the at least one elongated rail further includes a first surface, a second surface, a first edge and a second edge, the width of the rail across the first surface being wider than the width of the rail across the second surface such that both the first and second edges of the at least one elongated rail taper in from the first surface to the second surface, the second surface of the at least one elongated rail configured and arranged to engage a surface of the structure.

15. A shuttle for a fall protection assembly comprising:

a main body portion having opposed first and second sides, the main body including, a first holding member extending along the first side of the main body portion, the first holding portion configured and arranged to fit around a first edge of a rail, and at least one main connector coupled proximate the second side of the main body portion, the at least one main connector of the main body portion including a groove, a locking body portion having opposed first and second sides, the locking body portion including, a second holding member extending along the first side of the locking body portion configured and arranged to fit around a second edge of a rail, and at least one locking connector coupled proximate the second side of the locking body portion, the at least one locking connector pivotally coupled to the at least one main connector of the main body portion;

at least one locking member configured and arranged to selectively lock the locking body portion in a static position in relation to the main body portion, the at least one locking member being movably coupled to the locking body portion, the at least one locking member selectively received in the groove of the at least one main connector to lock the locking body portion in a static position in relation to the main body portion, the at least one locking connector of the locking body portion including a locking chamber;

the at least one locking member having an engagement portion, a barrel portion and a recessed portion, the recessed portion extending between the engagement portion and the barrel portion, the barrel portion having a bore, the barrel portion movably coupled in the locking chamber of the at least one locking connector;

a biasing member for each locking member, each biasing member received in the bore in the barrel of an associated locking member, the biasing member providing a biasing force on the associated locking member to retain the barrel portion of the associated locking member in a groove of an associated main connector to lock the locking body portion in the static position in relation to the main body portion, wherein a force on the engagement portion of the associated locking member counters the biasing force to position the recessed portion about the groove of the associated main connector to allow the locking body portion to pivot in relation to the main body portion; and a connector coupled to the shuttle configured and arranged to provide a connection point to the shuttle.

16. The shuttle of claim 15, further comprising:

at least one main body roller rotationally coupled to the first holding member of the main body portion, wherein the at least one main body roller is configured and arranged to engage the first edge of the rail to enhance movement of the shuttle along the rail; and at least one locking body roller rotationally coupled to the second holding member of the locking body portion, wherein the at least one locking body roller is configured and arranged to engage the second edge of the rail to enhance movement of the shuttle along the rail.

17. The shuttle of claim 15, wherein the connector further comprises:

a base portion rotationally coupled to the main body portion of the shuttle;

a connection loop; and an elongated member extending between the base portion and the connection loop.

18. The shuttle of claim 17, wherein the shuttle has a select width, the width defined between the first holding member extending along the first side of the main body portion and the second holding member extending along the first side of the locking body portion, the shuttle further having a midpoint along the width, the base portion rotationally coupled to the main body portion a select distance from the midpoint of the shuttle.

* * * * *